US011363876B2

(12) United States Patent
Silverberg

(10) Patent No.: US 11,363,876 B2
(45) Date of Patent: Jun. 21, 2022

(54) COSMETIC APPLICATOR HOLDER

(71) Applicant: Guide Beauty LLC, Rochester, NY (US)

(72) Inventor: Terri Silverberg, Winter Park, FL (US)

(73) Assignee: Guide Beauty LLC, Rochester, NY (US)

( * ) Notice: Subject to any disclaimer, the term of this patent is extended or adjusted under 35 U.S.C. 154(b) by 92 days.

(21) Appl. No.: 16/270,240

(22) Filed: Feb. 7, 2019

(65) Prior Publication Data

US 2019/0239620 A1 Aug. 8, 2019

Related U.S. Application Data

(60) Provisional application No. 62/627,860, filed on Feb. 8, 2018.

(51) Int. Cl.
*A45D 40/28* (2006.01)
*A45D 40/26* (2006.01)
(Continued)

(52) U.S. Cl.
CPC ..... *A45D 40/28* (2013.01); *A45D 34/045* (2013.01); *A45D 40/262* (2013.01);
(Continued)

(58) Field of Classification Search
CPC ..... A46B 5/02; A46B 5/021; A46B 5/023; A46B 5/025; A46B 5/026; A46B 5/028; A46B 7/04; A46B 9/021; A46B 5/0095; A46B 2200/1053; A46B 2200/1046; A46B 2200/106; A45D 40/00; A45D 2040/0012; A45D 2040/0025; A45D 40/262; A45D 40/264; A45D 40/265; A45D 40/261; A45D 40/26; A45D 40/28; A45D 34/042; A45D 34/043; A45D 34/045; A45D 34/041; A45D 34/04; A45D 2200/10; A47G 2200/046; B25G 1/10; B25G 1/102; Y10T 16/469; Y10T 16/476; B26B 21/522; B43K 23/004; B43K 23/008; B43K 23/012
USPC .... 132/213.1, 216, 218, 314, 317, 318, 320, 132/313, 290, 200; D4/138; 15/143.1, 15/176.1, 176.2, 176.3, 176.4, 176.5, 15/176.6
See application file for complete search history.

(56) References Cited

U.S. PATENT DOCUMENTS

D2,927 S 2/1868 Pusey
273,444 A 3/1883 Bixby
(Continued)

FOREIGN PATENT DOCUMENTS

FR 2886112 A1 12/2006
JP 2002306233 A 10/2002

OTHER PUBLICATIONS

International Search Report dated May 20, 2019 in International Application No. PCT/US2019/017090.

*Primary Examiner* — Jacqueline T Johanas
*Assistant Examiner* — Sharon E Kennedy
(74) *Attorney, Agent, or Firm* — Nixon Peabody LLP

(57) ABSTRACT

This invention relates to assemblies, components and method for application of cosmetic products. For example, a cosmetic applicator holder having a base that can be coupled to a makeup applicator and a ring portion for gripping between two fingers. The assemblies are designed to be easy and comfortable to use.

11 Claims, 11 Drawing Sheets

(51) Int. Cl.
*A45D 34/04* (2006.01)
*A46B 5/02* (2006.01)

(52) U.S. Cl.
CPC ..... *A45D 40/265* (2013.01); *A46B 5/02* (2013.01); *A46B 2200/106* (2013.01)

(56) References Cited

U.S. PATENT DOCUMENTS 343,391 A * 6/1888 Peiter
1,139,348 A 5/1915 Craig
1,366,975 A * 2/1921 Tomasulo ..... B26B 19/36 30/200
2,674,758 A * 4/1954 Fay ..... A46B 15/00 15/160
2,868,212 A 1/1959 Schoenberger
3,084,938 A 4/1963 Kapanowski
3,121,938 A 2/1964 Lind et al.
3,697,111 A * 10/1972 Thompson ..... A47K 5/05 294/189
4,211,445 A * 7/1980 Woods ..... A46B 5/04 294/187
4,283,854 A 8/1981 Austin
4,386,448 A * 6/1983 Kohn ..... A46B 5/02 16/441
D272,099 S 1/1984 Cassai
4,621,387 A 11/1986 Noser
4,922,575 A * 5/1990 Riemann ..... B25G 1/105 15/143.1
5,011,316 A * 4/1991 Damon ..... A47K 5/05 248/206.3
D349,512 S 8/1994 Law
D383,307 S 9/1997 Klein et al.
5,662,423 A 9/1997 Walden
6,039,053 A * 3/2000 Turrentine ..... A45D 40/262 132/317
6,131,231 A 10/2000 Huang
6,305,051 B1 10/2001 Cho
6,508,255 B1 * 1/2003 Glover ..... A45D 40/0087 132/216
6,732,411 B2 5/2004 Vidal
7,438,726 B2 * 10/2008 Erb ..... A61F 2/583 623/57
7,478,958 B2 * 1/2009 Ramet ..... A45D 40/26 401/123
7,549,686 B2 6/2009 Watanabe
8,387,263 B1 * 3/2013 Roberts ..... A47G 21/04 30/324
8,939,159 B2 1/2015 Yeo et al.
9,161,643 B2 * 10/2015 Prokop, III ..... B26B 1/10
9,265,334 B1 * 2/2016 Fung-A-Wing ..... A46B 5/0016
9,986,819 B2 * 6/2018 Flynn ..... A46B 9/04
10,111,513 B2 10/2018 Rhoades et al.
10,137,585 B2 * 11/2018 Gonterman ..... B26B 21/522
D861,271 S * 9/2019 Zemel ..... B25B 15/00 D32/46
D870,387 S * 12/2019 Sherrill ..... A45D 40/262 D28/57
11,154,977 B2 * 10/2021 Jackson-Coty ..... B25G 1/102
2011/0180089 A1 * 7/2011 Tranchant ..... A45D 29/12 132/200
2012/0043452 A1 * 2/2012 Karmatz ..... B25G 1/04 248/558
2014/0075763 A1 * 3/2014 Karns ..... A47G 21/08 30/322
2014/0109928 A1 * 4/2014 Simard ..... A45D 40/265 132/200
2014/0251359 A1 * 9/2014 Urrechaga ..... A45D 40/26 132/200
2014/0260838 A1 * 9/2014 Phui ..... B25G 3/12 81/489
2016/0000216 A1 * 1/2016 Morgan ..... A47J 42/00 15/111
2016/0271785 A1 * 9/2016 Hayes ..... A46B 5/021
2017/0156474 A1 6/2017 Fishcer et al.
2017/0265431 A1 * 9/2017 Urso ..... B25G 1/102
2018/0042705 A1 * 2/2018 Howe ..... A61C 13/0022
2018/0146767 A1 5/2018 Prade
2019/0366529 A1 * 12/2019 Chernik ..... B25B 15/00
2020/0140168 A1 * 5/2020 Chiang ..... A45F 5/02
2020/0253341 A1 * 8/2020 Barnett ..... A44C 15/00

* cited by examiner

COSMETIC APPLICATOR HOLDER

RELATED APPLICATIONS

This application claims benefit under 35 U.S.C. § 119(e) of the U.S. Provisional Application No. 62/627,860 filed Feb. 8, 2018, the content of which is incorporated herein by reference in its entirety.

FIELD OF THE INVENTION

This invention relates to assemblies, components and method for application of cosmetic products. For example, the embodiments of this invention include a ring holder for use with an applicator for applying mascara.

BACKGROUND

Applicators for cosmetic products (e.g., vessels, tools, and similar devices used to dispense and apply chemical formulations of makeup or removing these from the face) have not evolved significantly since the 1960s. Existing applicators are designed primarily to be aesthetically appealing and are typically not designed to ease the application of the cosmetic formulation. Such applicators typically require the user to rely on arm strength in holding the applicator with their hands, with arms raised and distanced from the face. Precise application of cosmetic formulations also requires steadiness, adequate vision, adept fine motor skills, eye-hand coordination, visual attention, depth perception, skill and/or training to achieve desired results. For example, proper application of eyeliner or mascara can be difficult and many people lack one or more attributes required to achieve the desired result. Consequently, some people avoid wearing eyeliner and mascara, spend additional time re-applying or modifying an application of a cosmetic application, accept an inferior application, or avoid applying the mascara or eyeliner themselves, for example paying a professional makeup artist to apply the cosmetic formulation for them.

Existing cosmetic formulation-applicators often have handles, grips, lids, etc. that are considered difficult to hold. This is especially true for an increasingly important segment of the population, namely the elderly and/or physically handicapped, disabled, or impaired persons. These individuals often experience diminution of muscle control and strength in their extremities, tremors, stiffness in joints, and/or poor eyesight. Some such impairments or disabilities may be, associated with a degenerative disease such as Parkinson's Disease, Multiple Sclerosis, Arthritis, Essential Tremors or the like. Clearly the difficulties in applying cosmetics are exacerbated for these individuals. In addition, some of these individuals lack the support, for example of a caregiver or lack funds to hire a makeup artist to apply makeup for them.

Therefore, there exists a need for improved cosmetic applicators that address one or more of these deficiencies.

SUMMARY

In general, the inventions described herein relate to applicators for applying a cosmetic formulation that are designed for convenient and ergonomic use as well as being stylish. For example, a holder for use with an applicator such as a brush, or the like, for applying or removing mascara, eyeliner, blush, lipstick, and/or another suitable cosmetic formulation.

In one aspect the invention comprises a cosmetic applicator holder, the holder comprising a base having a finger contact area configured for contact with a user's volar or dorsal surface of two fingers. A shaft extends from the base along a shaft primary axis and is configured to be placed between and contacting the sides of the two fingers. On the shaft, there is an enlarged portion (e.g., the "ring") extending from the shaft and positioned distal to the base, the enlarged portion having a surface configured for contact with the volar or dorsal surface of the two fingers. The applicator also includes a coupling element, for example on the base, configured for coupling of an applicator to the base. Optionally, the applicator coupling element is configured to couple to an applicator handle so that a primary axis of the applicator handle is oriented substantially perpendicular to the shaft primary axis. Optionally, the applicator coupling element is configured for removably coupling the applicator to the base, for example, so that the applicator can be reused or the holder can be used with different kinds of applicators. Optionally, the base further comprises a thumb grip area disposed on a surface generally opposite to the finger contact area. Optionally, the thumb grip area is a substantially flat portion on a holder surface shaped and positioned such that the user's thumb can be comfortably fit thereon when the user grips the holder such that the volar surface of at least one finger is in contact with the finger contact area of the base. Also, optionally, the thumb grip area comprises a textured surface for assisting in preventing the user's thumb from slipping when it is being used. Optionally, the coupling element and applicator handle comprise a male and female coupling combination or pair. Optionally, the holder further comprises a bearing or fitting element for secure fastening of the applicator handle to the coupling element, for example securing the handle into the bearing which is placed into an indentation formed in the base.

In another aspect, the invention comprises an assembly, wherein the assembly comprises a holder including an applicator coupling element, an applicator having a handle coupled to the holder via an applicator coupling element, and a vessel configured for connecting to the holder and over the applicator during storage. Optionally, the applicator comprises an eyelash, eyelid, cheek lip, or eyebrow applicator (e.g., brush, comb, scraper or lipstick container or tube). Optionally, the applicator comprises a tip curved away from a principle axis of the handle and/or comprises a peek or see-through hole. Optionally, the applicator tip comprises at least two working surfaces for applying a cosmetic formulation.

In yet another aspect, the invention comprises a method for applying makeup. The method comprises holding an applicator holder fitted with an applicator and contacting the applicator to the application area, wherein holding comprises placing a shaft of the holder between two fingers of one hand. Optionally, holding comprises orienting the hand so that a primary axis of a handle of the applicator is oriented in a direction substantially parallel with a plane defined by two phalanges of the two fingers and perpendicular to the shaft primary axis. Optionally, the holding comprises contacting the volar surface of the two fingers to a finger contact area of a base of the holder and contacting the dorsal surface of the two fingers with an enlarged portion of the holder. Optionally, holding comprises contacting the dorsal surface of the two fingers with the finger contact area of the base and contacting the volar surface of the other finger with the enlarged portion of the holder. Optionally, the holding comprises contacting the dorsal surface of the two fingers with a finger contact area of the base of the holder and contacting the volar surface of the other finger with an enlarged portion of the holder. Optionally, the method further comprises contacting a thumb, a finger or a palm of the hand to the face to provide stabilization of the hand during makeup application. Optionally, the holder includes a thumb grip and the holding comprises contacting the thumb of the hand to the thumb grip. Optionally, applying makeup comprises applying or removing a formulation to the eyelashes, eyebrows, cheeks, face, skin, hair or lips.

The cosmetic applicator holder is generally ergonomic and designed for use even with people having disabilities or impairments such as tremors, arthritis, other challenges that can occur due to age or other reasons, combinations thereof, and/or the like. The holder provides easy and ergonomic use so that the user can comfortably and gently apply makeup or otherwise treat the skin, eyelashes, eyebrows, lips, face, skin, hair or the like.

BRIEF DESCRIPTION OF THE FIGURES

FIG. 2A is a front cross cut view, FIG. 2B is a side cross cut view and FIG. 2C is a bottom cross cut view.

Figure 1A:
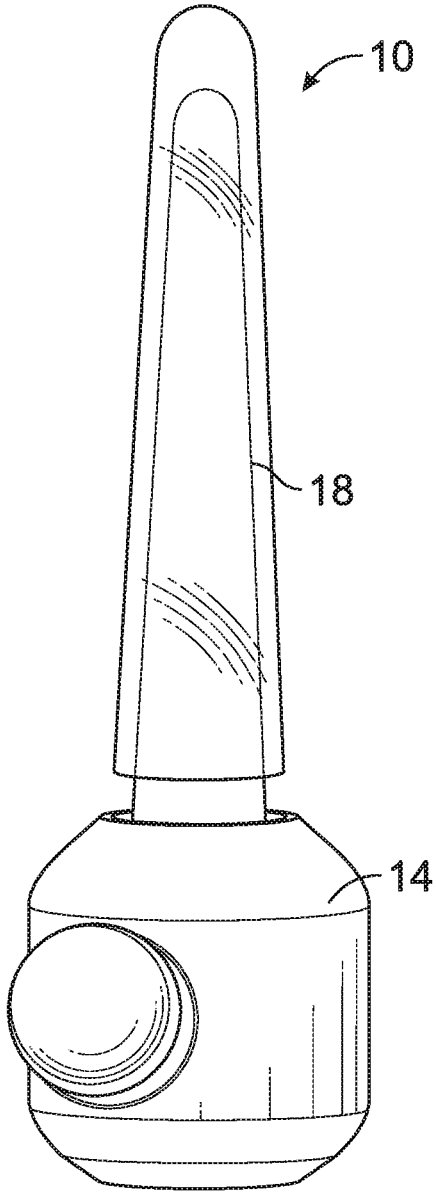
FIGS. 1A-1C show an embodiment of a cosmetic applicator holder assembly.

The present disclosure is susceptible to various modifications and alternative forms, and some representative embodiments have been shown by way of example in the drawings and will be described in detail herein. It should be understood, however, that the inventive aspects are not limited to the particular forms illustrated in the drawings. Rather, the disclosure is to cover all modifications, equivalents, and alternatives falling within the spirit and scope of the invention as defined by the appended claims.

DETAILED DESCRIPTION

The methods, compositions, and structures provided herein are based on the discovery and design of a cosmetic applicator holder that is ergonomic and easy to use. The design includes a feature that appears as a ring when held between two fingers and facilitates manipulation of the applicator while using it to apply makeup. For example, the holder does not require more than two fingers of one hand for manipulation. It is a feature of the embodiments described herein that the design of the holder allows for multiple ways to orient and use a cosmetic applicator, some embodiments of which are described herein but which are not limiting.

Figure 1B:
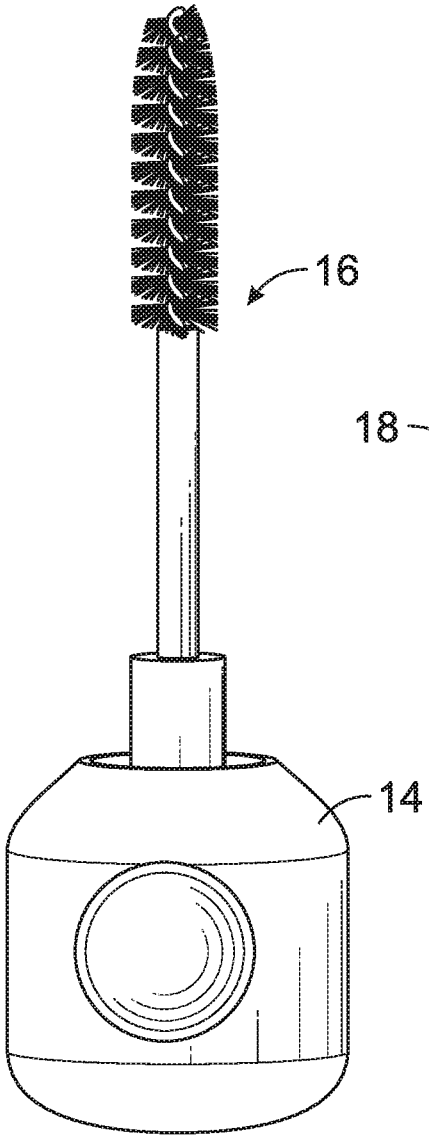
Figure 1C:
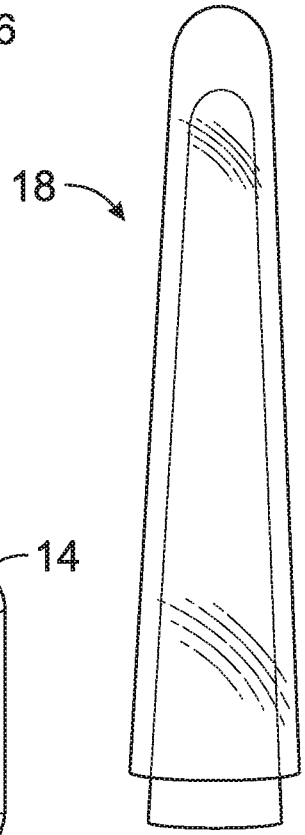

FIGS. 1A-1C, show an embodiment of a cosmetic applicator holder assembly 10 as an "all-in-one product," including a cosmetic applicator holder 14, an applicator 16 configured as a brush (spoolie), and a vessel 18 configured to enclose the applicator 16 and for containing a cosmetic formulation. In some embodiments the vessel 18 is a protecting enclosure to protect the applicator from damage or contamination and/or as a container to seal onto the holder 14 so that formulation solution does not spill out and contaminate the surrounding areas (e.g., clothing or a purse in which assembly 10 is placed). Any useful method of sealing can be used, such as, but not limited to, a screw coupling (e.g., where the holder 14 and vessel 18 have matching threads so they can be screwed to each other).

Figure 2A:
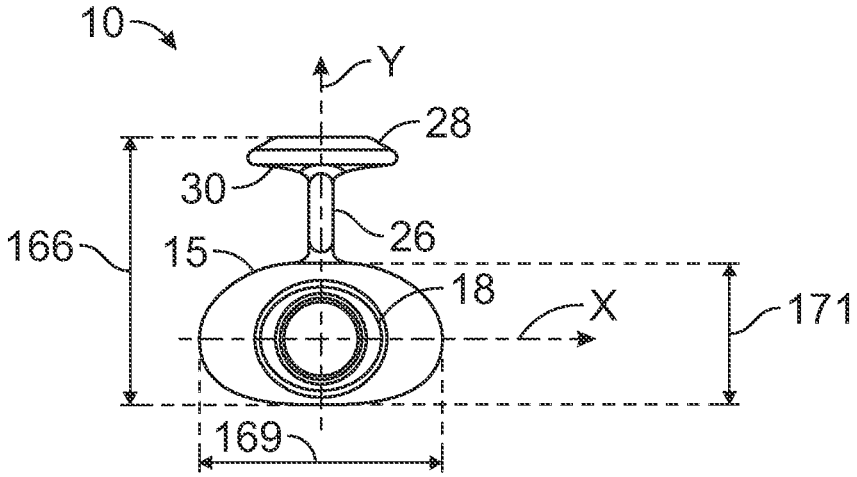
FIGS. 2A-2C show different views of a drawing of an assembly according to embodiments described here.
Figure 2B:
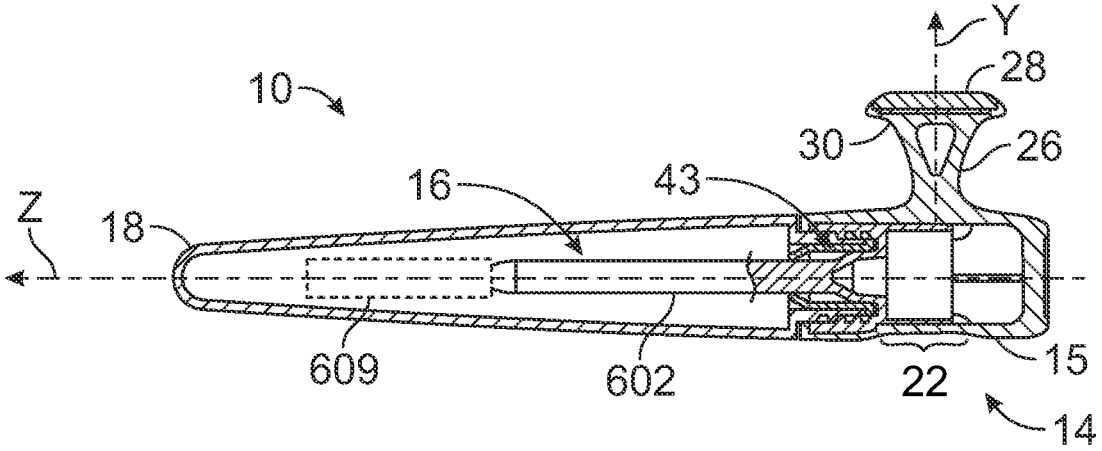
Figure 2C:
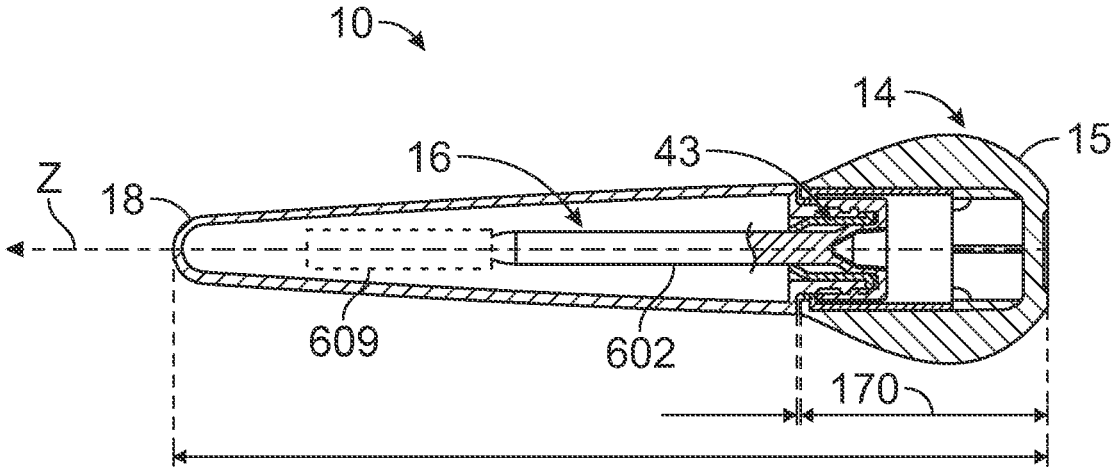

FIG. 2A-2C show different views of an assembly 10 according to one non-limiting embodiment. The applicator 16 can include sub components such as the applicator tip 609, and a handle 602. As shown, by these figures, the holder 14 includes a base 15, a shaft portion 26 extending therefrom in the direction of the primary axis Y and an enlarged portion 28 (e.g., the ring) positioned on the opposite end of the shaft portion 26. The enlarged portion 28 includes an inner surface 30 which meets, and continues the surface of the shaft 26. In some embodiments, the base 15 includes a thumb grip 22 which is indicated by an indented bracketed region 22 in FIG. 2B. The shaft 26 is configured to be easy to lightly grip between two fingers, and the applicator handle 602 can be oriented in any direction with respect to the hand, as will be described in more detail. An axis X orthogonal to the axes Y and Z, a total height 166, height of the base 171, width 169 and length 170 dimensions are also indicated in these FIGS. 2A-2C.

As shown in FIGS. 1A-1C and FIG. 2A-2C the base 15 has an outer, generally curved surface defining a closed, generally rounded shape such as a distorted, flattened and/or elongated sphere or lozenge. The shaft 26 and the enlarged portion 28 can also have a curved shape, where the joining or connection between the base 15, the shaft 26, and the enlarged portion 28 are generally smooth and continuous. This organic shape is designed for both comfort and elegance. Flattened or more angular areas that do not diminish these design goals can also be implemented. For example, flattened areas making the holder 14 easier to place on a table top so it does not roll or tip over are contemplated. In addition, in some embodiments, the general shape of the holder 14 is symmetric, as shown here, while in some other embodiments, the holder 14 is less symmetric, for example, to match the right or left handedness of the user The applicator handle 602 and holder 14 can be removably coupled or connected to one another so that the applicator handle 602 it is disposed along primary axis Z, which is perpendicular to the shaft primary axis Y. As used herein "removably" coupled or connected means that the applicator 16 can be coupled or connected to the holder 14 more than one time without damaging the holder 14 and/or the applicator 16. The coupling elements can include or be configured as a male to female connection. For example, the coupling element 43 can include a hole or indentation in the base 15 of holder 14, the indentation configured to couple (e.g., connect, accept) to the applicator handle 602. In some other embodiments the coupling element 43 includes a protrusion on base 15 and the applicator handle 602 has a matching indentation or hole for coupling thereto. In some embodiments additional elements to help secure an applicator handle 602 to a holder 14 such as a bearing elements, protrusions, tapers, threads, pins, fasteners, any combination of these, or the like. For example, screw elements such as a helical thread on applicator handle 602, distal to applicator tip 609, and a matching helical groove in an indentation on holder 14 so that the applicator handle 602 is screwed into holder 14. Or, as another example, a taper on and at the end of applicator handle 602 distal to tip 609 and a matching taper in an indentation on holder 14 is provided, so the applicator handle 602 can be pushed into the indentation in holder 14, providing a secure coupling or connection. In some embodiments magnetic means are used to secure the applicator 16 to the holder 14, such as having some ferrous material in the s applicator handle 602 and a magnetic material in the coupling element 43, or a ferrous material in the coupling element 43 and magnetic material in applicator handle 602.

In some embodiments the handle 602 is coupled to be an integral unit with holder 14. For example, the applicator such as 16 is not removable from the holder 14.

Figure 3A:
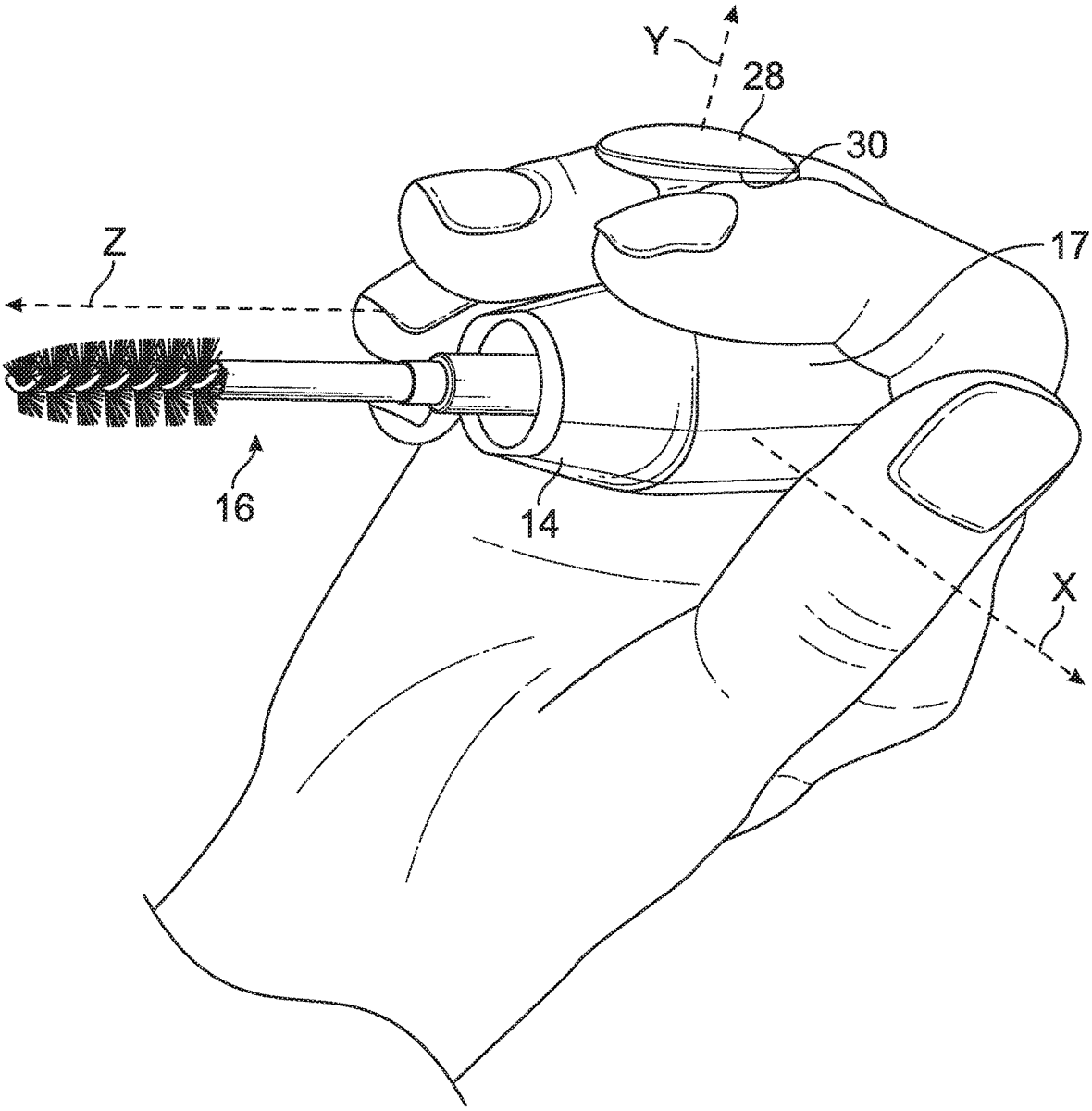
FIGS. 3A and 3B shows how a holder with an applicator attached thereto can be held according to some embodiments
Figure 3B:
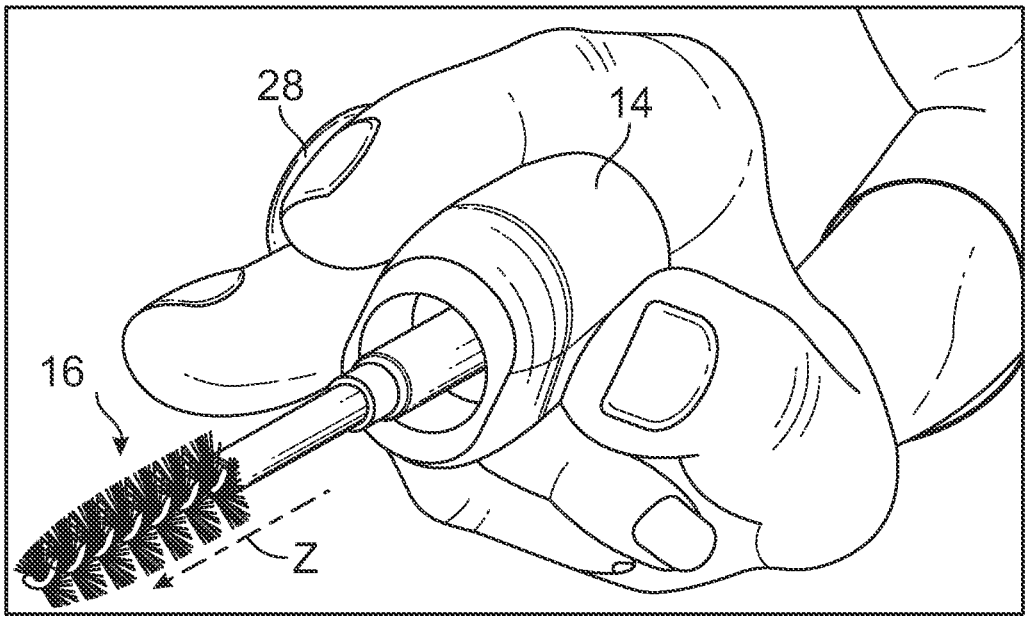
Figure 4:
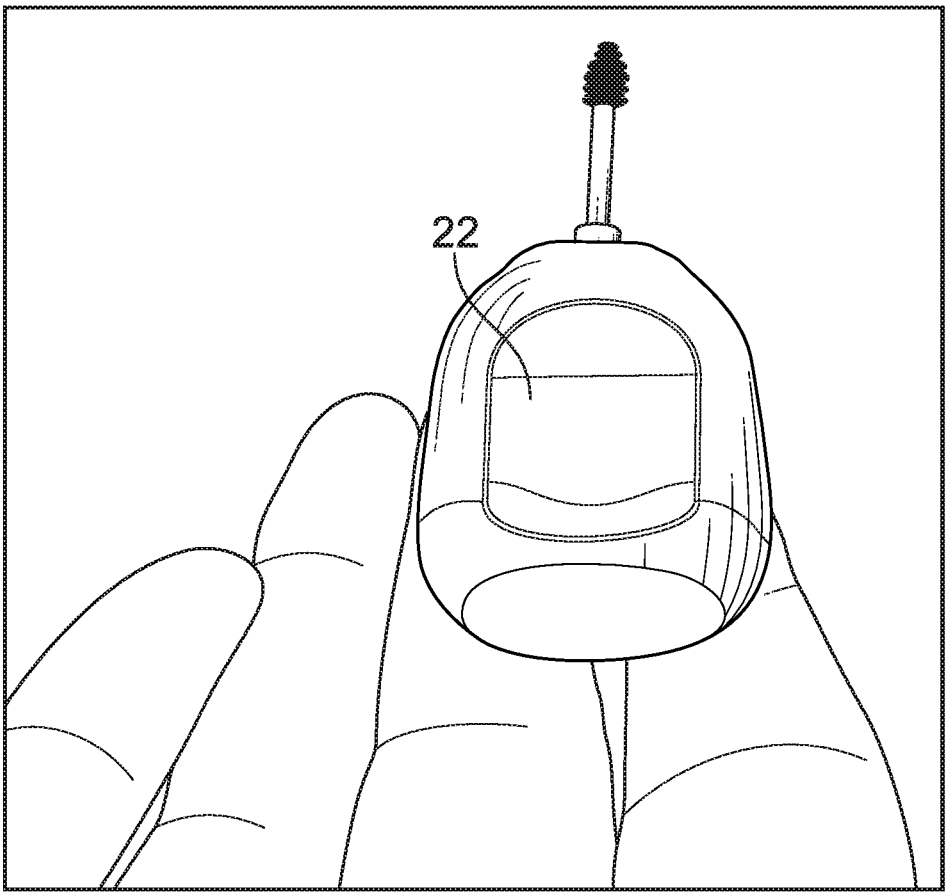
FIG. 4 shows an embodiment of a holder with a thumb grip.

FIGS. 3A and 3B shows how the holder 14 with applicator 16 attached can be held according to some embodiments. The shaft portion 26 (shown in FIGS. 2A-2C but obscured in FIGS. 3A and 3B by the index and middle finger) is shaped and positioned to rest comfortably between two of a user's fingers so that an outer surface of the shaft contacts the sides of two fingers. A finger contact area 17 on the base 15 can be contacted with the inner or volar side of the two fingers, while the outer or dorsal side of the two fingers can be contacted with the inner surface 30 of the enlarged portion or ring 28. Thus, a user need not close his/her hand over the base 15 in order to hold the holder 14, freeing up more digits for stabilization. For example, fingers not used for holding 14, as well as the thumb or palm can be used to steady or ground the hand against the face (e.g., cheek, or chin). In some embodiments the thumb is used to stabilize the base 15 from a side, as shown in FIG. 3A. In some other embodiments of use, the inner portion of one or more fingers rest on one side of the base 15, while the thumb rests on the generally opposite side of the holder base 15, generally opposite to the finger contact area 17, as shown in FIG. 3B. In some embodiments, the thumb is place on a thumb grip 22. In other embodiments the thumb is not used for holding or stabilization A holder 14 having a thumb grip 22 is shown in FIG. 4, according to one embodiment. The thumb grip 22 can provide additional support and dexterity. The thumb grip 22 is a substantially flattened portion on the holder 14 shaped and positioned such that a user may comfortably fit his or her thumb thereon. In some embodiments, the thumb grip 22 may have a curved surface substantially conforming to the shape of a thumb surface. In some embodiments, the thumb grip 22 includes a textured surface thereon to assist in preventing the user's thumb from slipping when the holder 14 is used. Substantially flattened or substantially flat as used herein refers to at least a portion of the surface comprising the thumb grip 22 has an average radius of curvature (e.g., not including any texturing) greater than about 5 cm (e.g., greater than about 10 cm, greater than about 20 cm).

Figure 5A:
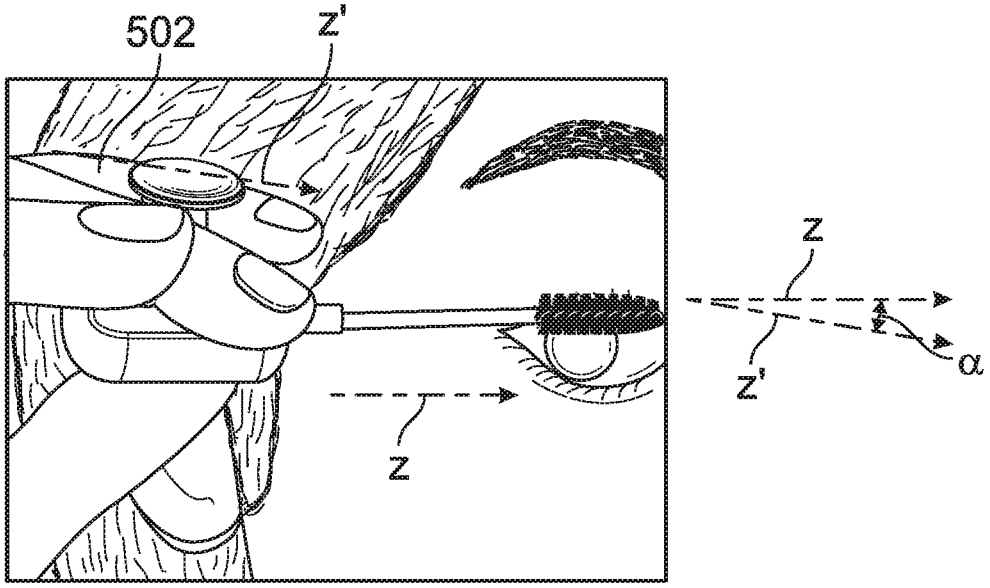
FIGS. 5A and 5B show embodiments illustrating a use of a holder with an applicator.
Figure 5B:
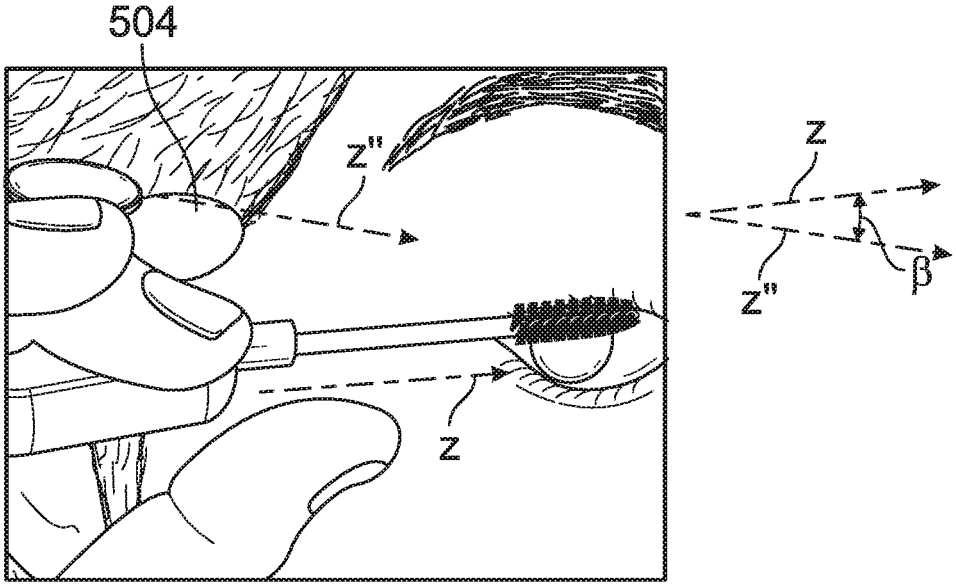

FIGS. 5A and 5B show non-limiting embodiments for the use of the holder 14 with an applicator 16 such as a mascara and lash applicator. As shown in FIG. 5A, the applicator direction along axis Z is substantially in line with the intermediate phalanges 502 of at least one of the two fingers. By substantial in line it is meant a vector defined by a line along the largest dimension of the intermediate phalanges, Z' in FIG. 5A, intersects the direction defined by axis Z at an angle $\alpha$ that is not more than about 20 degrees (e.g., not more than 10 degrees). In other embodiments the axis Z" of distal phalange 504 is substantially in line with the Z axis, as shown in FIG. 5B, where angle $\beta$ is not more than about 20 degrees (e.g., not more than 10 degrees). In some embodiments an intermediate phalange of a first finger and a distal phalange of a second finger are substantially in line.

As shown in FIG. 5B, the design of the holder 14 allows a user to ground (e.g., rest, steady or support) the holder 14 by contacting his or her thumb against his or her cheekbone, thereby blunting tremors possibly experienced during application and aiding in steadying the user's hands during application. In other embodiments for holding 14 other fingers or the palm can be used for grounding or steadying the hand as previously described.

Figure 6A:
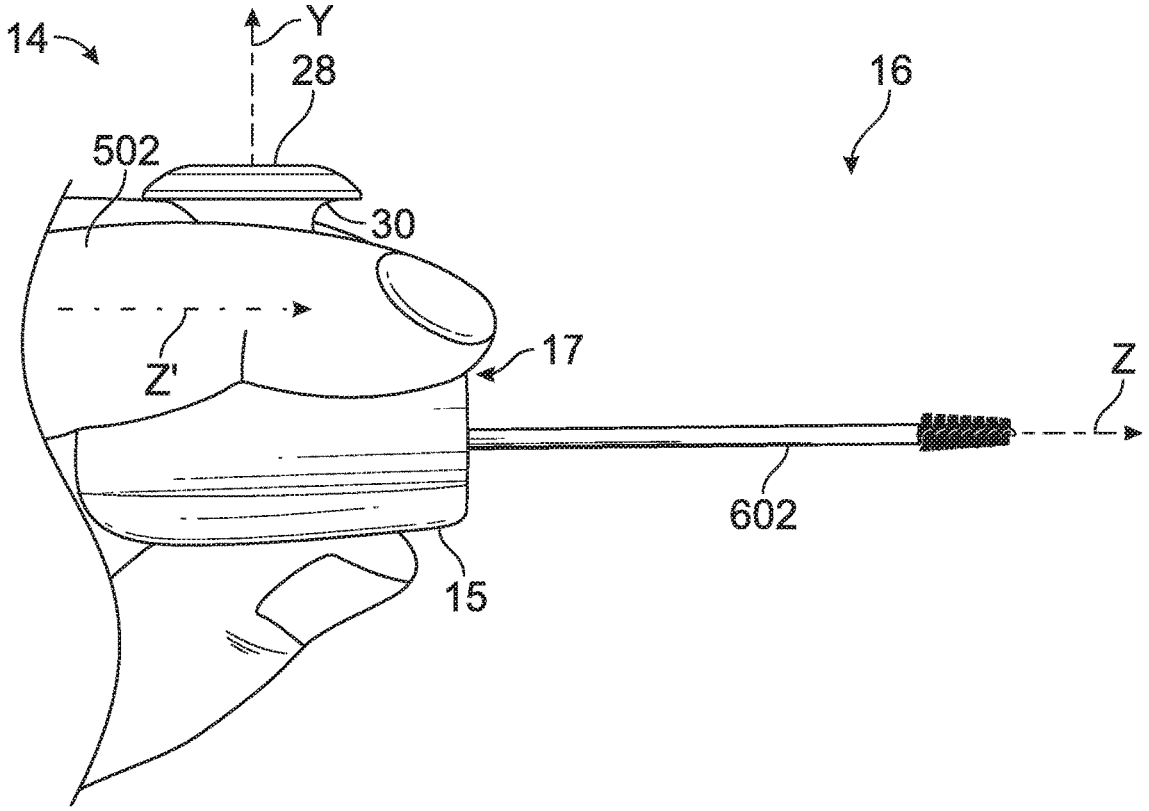
FIGS. 6A-6D shows some methods of holding an applicator according to some embodiments.
Figure 6B:
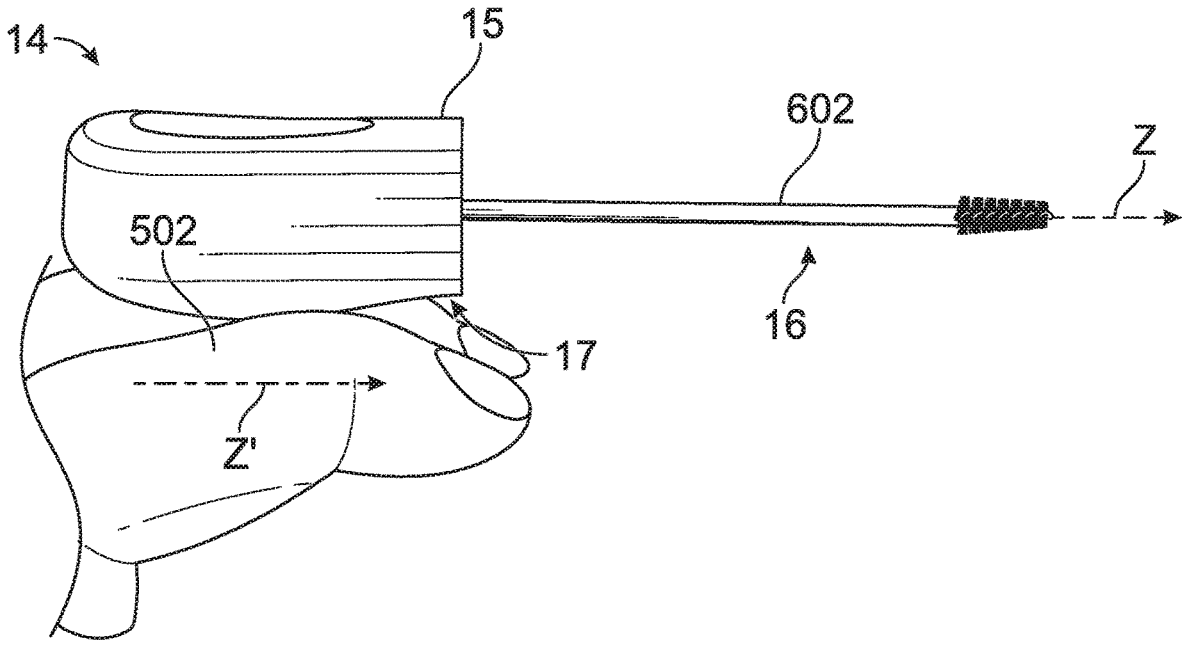
Figure 6C:
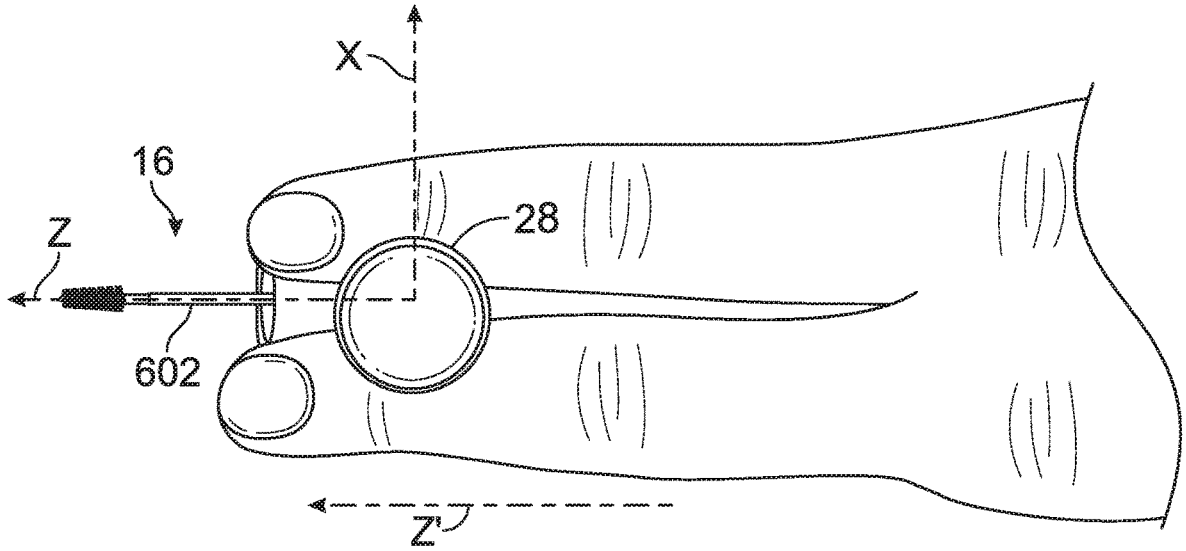
Figure 6D:
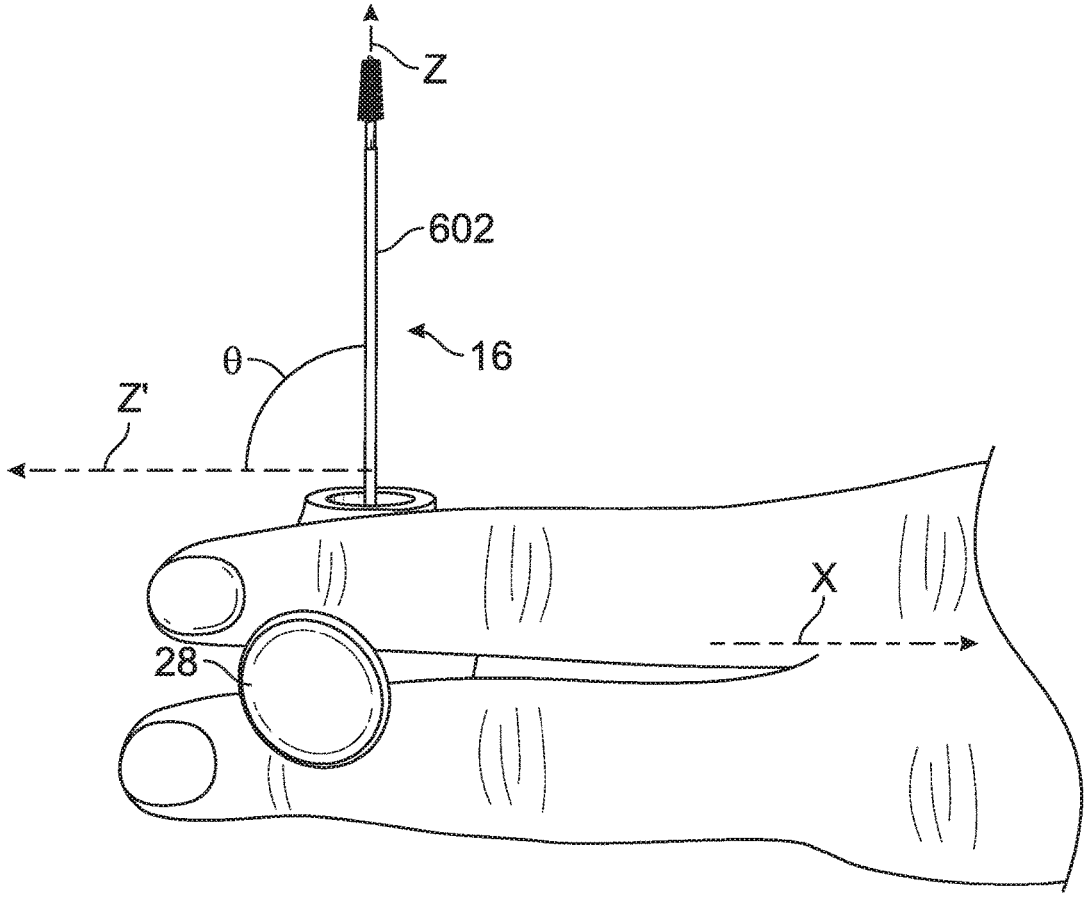

FIGS. 6A-6D illustrate non-limiting techniques and methods of holding applicator holder 14 with an applicator 16 using at least two fingers. FIG. 6A shows an embodiment for holding similar to FIG. 5A, where the finger contact area 17 on the base 15 can be contacted with the inner or volar side of the two fingers, and the handle 602 of the applicator 16 is oriented in a direction substantially parallel to the intermediate phalanges of the two fingers. FIG. 6B shows an orientation where the finger contact area 17 of the base 15 contacts the dorsal part of two fingers and the volar surface of the fingers contacts inner surface 30 (see FIGS. 6A and 2B) of the enlarged portion or ring 28. The direction or extension of the applicator 16 (e.g., the direction of extension of the applicator handle) shown in FIG. 6B is similar to that shown in FIG. 6A but the enlarged portion 28 is on the opposite side of the hand. FIG. 6C shows an embodiment where the direction of extension of the applicator handle 602, Z, is substantially parallel to the direction of extension Z' of the phalanges of the extended fingers holding the applicator 14. The finger volar surface contacts the finger surface 17 of the holder 14, similar to FIG. 6A. In another embodiment (not shown) the enlarged portion 28 may be positioned on the opposite, dorsal side of the fingers, but in an otherwise similar orientation to that shown in FIG. 6C. FIG. 6D shows an orientation where the direction of extension of the applicator handle 602, Z, is substantially perpendicular (e.g., ±20 degrees to exactly perpendicular) to the direction Z' or extension of phalanges of the extended fingers. In another embodiment (not shown) the enlarged portion 28 may be positioned on the opposite, dorsal side of the fingers, but in an otherwise similar orientation to that shown in FIG. 6D. FIGS. 6C and 6D show two possible embodiments for how the applicator 16 can be oriented in the plane defined by X and Z, and should not be construed as limiting. The applicator can be oriented in any direction substantially parallel to the plane defined by X and Z for example by rotation on around the principle axis Y of enlarged portion 28. That is, the angle $\theta$ defined by the direction of the applicator handle Z and extending direction of phalanges Z' can be any value (e.g., between and including 0 degrees and 360 degrees). In addition, the thumb (e.g., using the thumb grip) and other fingers in addition to the fingers shown in these figures can be rested on holder 14 depending on the orientation. The plane X and Y are also generally parallel to a plane defined by two phalanges of the two fingers and generally perpendicular to the shaft primary axis Y.

The holder 14 and the associated features may also be utilized with other types of cosmetic products and applicators, including, but not limited to, lip products (e.g., lipstick, lip gloss, lip pencils, and the like), foundation applicators, concealer, and the like. As used herein applicators relate to any implement for contacting the skin such as for applying or removing makeup, or grooming such as brushing, scraping or combing. For example, the applicator can be applicator 48, configured as a spoolie (e.g., 488 or 490, FIG. 7), or configured as a brush (489 or 487, FIG. 7).

Figure 7:
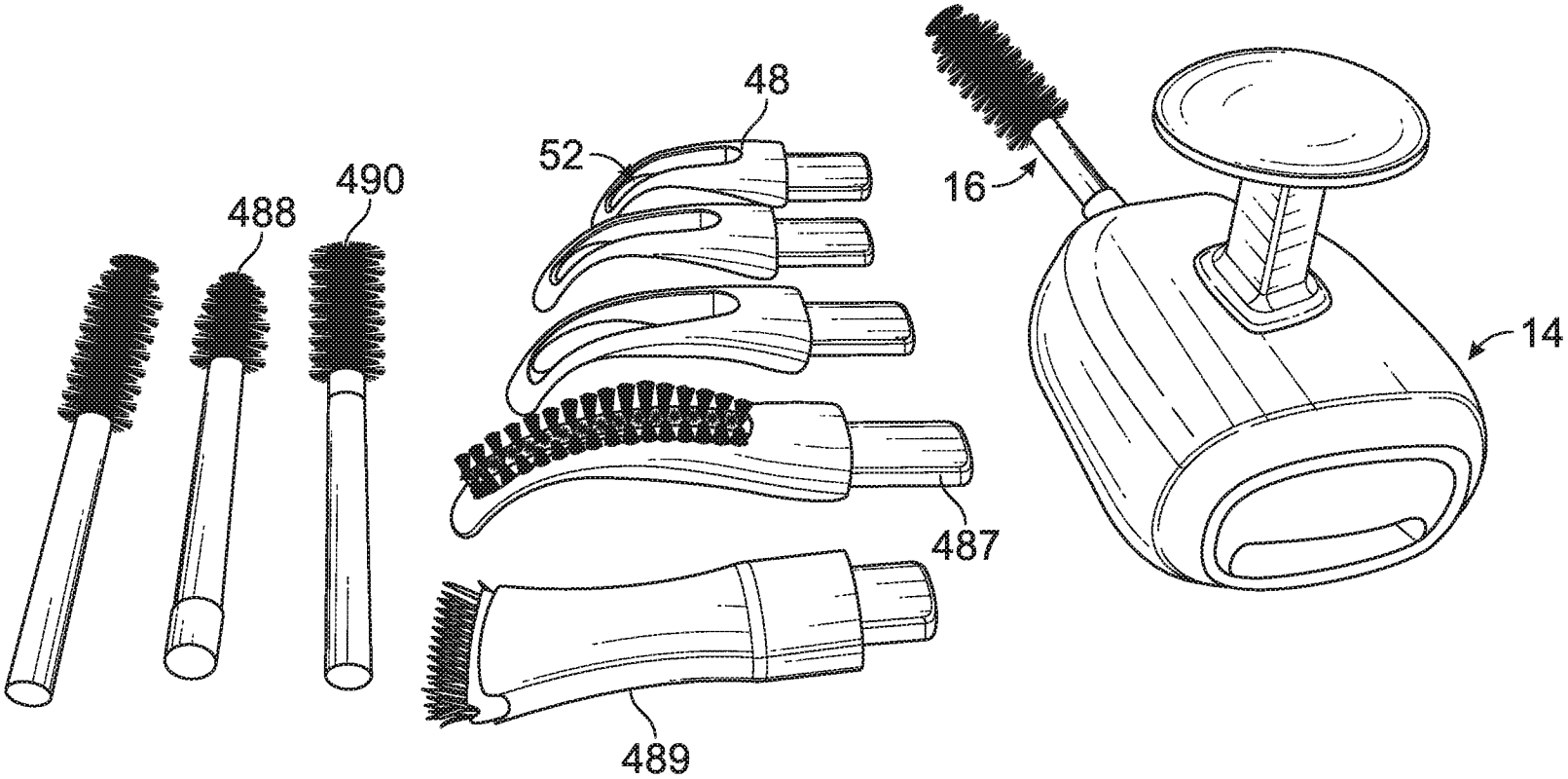
FIG. 7 shows some applicators and a holder according to some embodiments.

FIG. 7 shows an embodiments of a kit comprising a holder 14 and various applicators. For example, applicator 48 (e.g., have through hole 52), 486, 487, 488, 489, and 490. In some embodiments the kit can include other items such as cosmetic or skincare application formulations. The kit can also include a container for holding the kit items such as one or more of applicators, 48, 486, 487, 488, 489, and 490, one or more holder (e.g., holder 14 or this like), containers holding cosmetic or skincare application formulations, and a mirror. The kit container can include indentations, grooves, straps, bands or other means for keeping the items there in place.

Figures 8A, 8B, 8C:
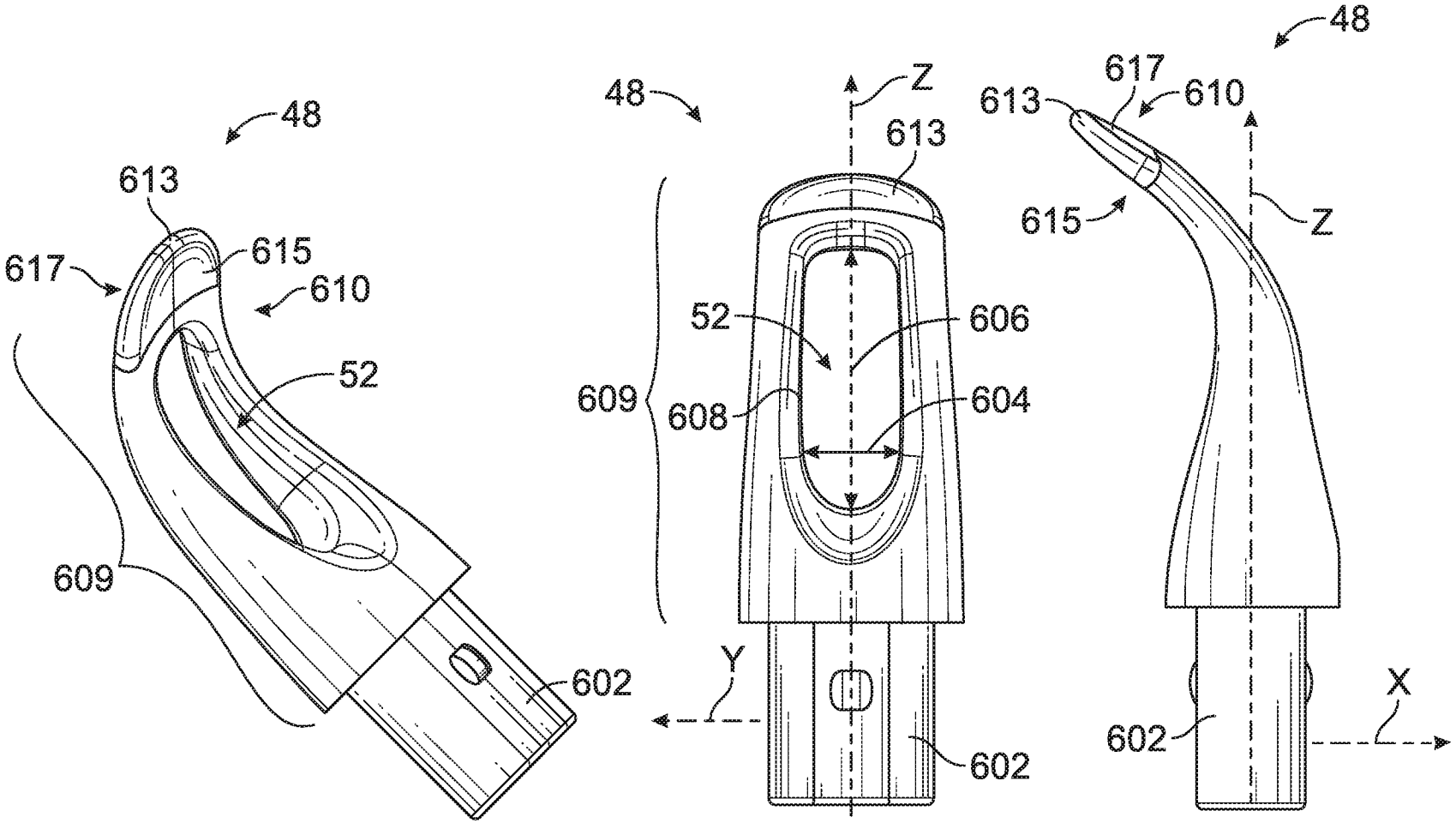
FIGS. 8A-8C show one embodiment of applicator.

FIGS. 8A-8C illustrate an applicator 48 according to one non-limiting embodiment. A shaft or handle 602 of the applicator 48 as well as the peek hole 52 are shown. The peek hole 52 is disposed in a tip area 609 or region of the applicator 48 and is configured to make it easier to apply makeup since it provides more visibility of the eye when using a mirror. A width 604 and height 606 dimension of the peek hole 52 are indicated. These dimensions, 604 and 606, indicate the general direction and can include different numerical or scalar values such as between a minimum value and a maximum value as illustrated in the figures. That is, the peek hole width 604 can vary in value along the direction of axis Z and the peek hole height 606 can vary in the direction of axis Y. As such, the peek hole 52 may vary in size and shape in the different embodiments of the invention. In some embodiments the peek hole 52 is symmetric in one or more reflection planes, as shown in FIG. 6B. In some other embodiments, the peek hole 52 is not symmetric. In some embodiments, the viewing area is at least one centimeter square (e.g., at least 1 $cm^2$, at least 1.5 $cm^2$, at least 2 $cm^2$), wherein the viewing area is defined as the maximum area of projection through the peek hole 52. For example, the viewing area may be defined by the area circumscribed by edge 608 and projected on a plane perpendicular to axis X and Y. In some embodiments the minimum width 604 and/or minimum height 604 of the viewing area is at least 2 mm (e.g., at least 3 mm, at least 4 mm, at least 5 mm). The applicator 48 includes an application or working portion 610 which is configured for contact with the user's skin (e.g., an eyelid).

In some embodiments as shown in FIGS. 8A-8C, the tip area 609 can feature a wide application or working portion 610. As used herein, "wide" contrasts with a traditional eyeliner makeup pencil (e.g., the pencil tip) and brushes (e.g., with pointed tips) used for applying brow, eye, lip and similar cosmetic products. which have a more pointed tip with less applicator surface as the "working" surface (e.g., "working" is the surface contacting the skin during application. For example, the width of the working portion in the X direction in some embodiments is at least 0.2 cm (e.g., at least 0.5 cm, at least 0.75 cm or at least 1 cm). As used herein the working portion 610 refers to the surface that is rubbed against the skin such as when applying a cosmetic formulation. The tip area 609 has a curved shape so that application or working portion 610 protrudes way from the principle axis Z. Some other features of the applicator 48 are that working portion 610 has multiple working surfaces and areas that can be used for contact with the eye area. In some embodiments, the working portion 610 has at least two working surfaces (e.g., at least 3). For example, the working portion 610 of FIGS. 8A-8C include a first surface 615, a second surface 617 and a third surface 613. At the first surface 615, the tip area 609 becomes thinner; that is, the distance between second surface 617 and the first surface 615 gets smaller, so that the surface area of 613 is small and allows a precision line of cosmetic formulation using the third surface 613 to be made. The first surface 615 and second surface 617 provide a wide surface for application of cosmetic formulations, for example, to the waterline of an eye.

The shaft 602 is configured to connect to a holder such as holder 14 through a coupling element, such as coupling element 43. This coupling can be as a male to female combination as previously described. For example, the coupling element, such as 43, can include a hole or indentation that is configured to couple (e.g., connect, or accept) to the shaft 602 In another embodiment, a hole or indentation is disposed on the applicator 48 and a protrusion or shaft on the holder, such as a holder 14 is configured to couple (e.g., connect, or accept) to the shaft 602. In some embodiments additional elements to help secure the applicator 48 through shaft 602 may be used, such a bearing elements, protrusions, tapers, threads, pins, fasteners, any a combination thereof, of the like. For example, screw elements such as a helical thread on shaft 602, distal to applicator tip 609, and a matching helical groove in an indentation on a holder, such as holder 14, so that the applicator shaft 602 is screwed into the holder. Or, as another example, a taper on and at the end of shaft 602 distal to tip 609 and a matching taper in an indentation on a holder, such as holder 14 is provided, so the applicator shaft 602 is pushed into the indentation in the holder providing a secure coupling or connection. In some embodiments, magnetic means are used to secure the applicator 48 to a holder, such as holder 14, such as having some ferrous material in the shaft 602 and a magnetic material in the coupling element such as coupling element 43, or a having ferrous material in the coupling element and magnetic material in shaft 6021*t* is understood that in other embodiments wherein a different applicator is used, similar components can be used to couple a shaft of the applicator to the holder.

In some embodiments the applicator 48 includes a flexible material such as a urethane or silicone. As used here "flexible" refers to material that may be easily bent such as with the force of a finger pushing on it, yet may hold its shape to allow use as, for example, an eyeliner applicator. Additionally, or alternatively, in some embodiments, the applicator 48 includes a material that is soft and comfortable for brushing or sliding across skin, e.g., near a delicate eye area. Some non-limiting examples of materials that can be used include silicone, thermoplastic polyurethane (TPU), thermoplastic elastomers (TPE) any combinations thereof, and the like. In some embodiments, the material comprises TPE, such as TPE that is injection molded. In addition to being made of a material that is soft yet holding its shape, the material, such as TPE, is easier to keep clean than, for example synthetic or natural brush hair.

In some embodiments the applicator, e.g., applicator 48, is disposable and therefore does not require washing and can be delivered and appropriately packed as a sterile item. In some embodiments the applicator is re-usable and is therefore washable and can be sterilized. Accordingly, the applicator, e.g., applicator 48, can be removably coupled a holder such as holder 14. As used herein "removably" coupled or connected means that the applicator can be coupled or connected to the holder, such as holder 14. more than one time without damaging the holder 14 and/or the applicator 48.

Although the applicator 48 can be combined in an assembly with a holder 14 providing an assembly for cosmetic application that is flexible, versatile and easy to use, the applicator 48 can be used with many holders not limited to those shown in the illustrated embodiments and described herein. For example, holders having an elongated wand like shape as well as round or egg shaped can be used.

Figure 9:
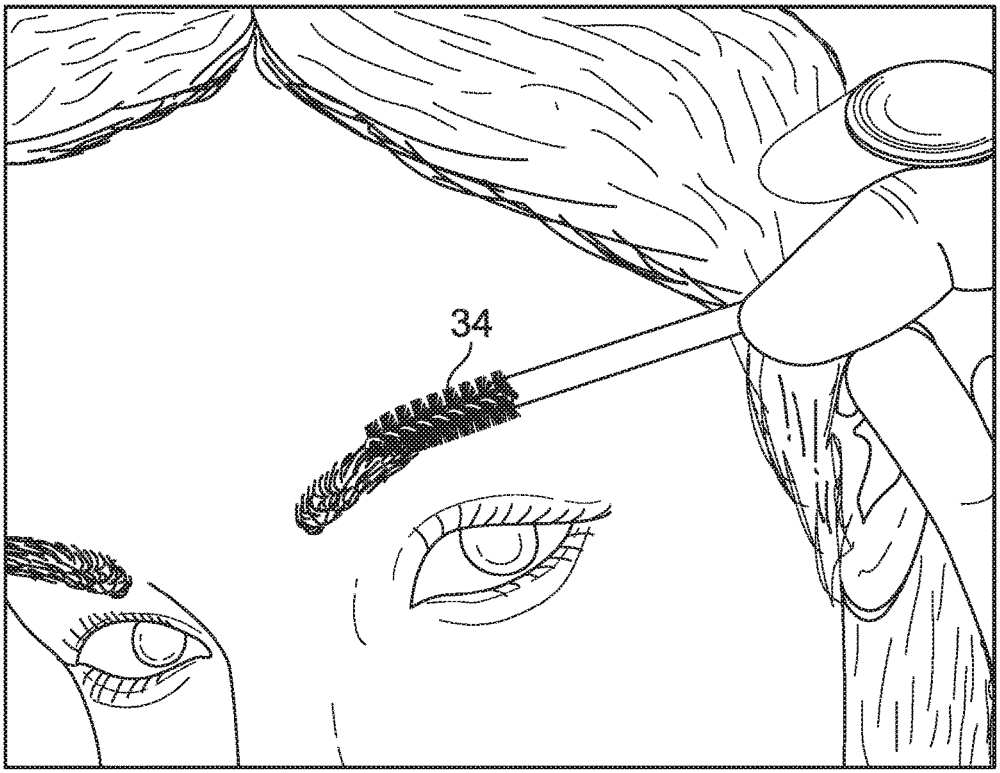
FIG. 9 shows embodiments illustrating a use of a holder with a brow brush.

In some embodiments, as shown in FIG. 9 the holder 14 can be used with a brow brush 34. The brow brush 34 and holder 14 assembly can be beneficial since it is relatively easy to use. The brow brush 34 and holder 14 assembly assists in simplifying the process of filling, shaping, and/or temporarily coloring the eyebrow and/or provides a one-step process allowing for multiple brow looks. The brow brush 34 and holder 14 assembly is generally easy to control and stays relatively steady. The small tip may assist in giving a more natural look and can brush in small dashes.

Figure 10:
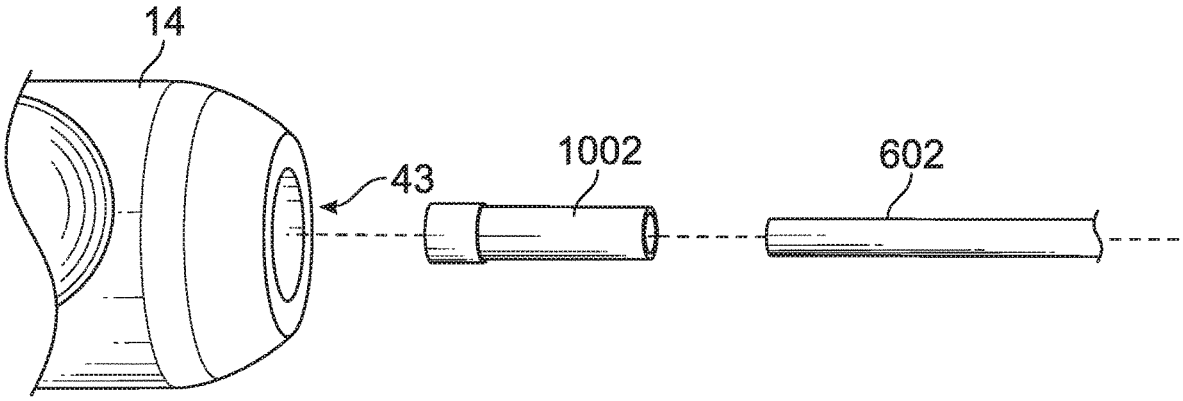
FIG. 10 shows a holder coupled to a handle of an applicator using a bearing element according to some embodiments.

In some embodiment, as shown in the exploded view of FIG. 10, the holder 14 can be coupled to a handle 602 of an applicator using a bearing element 1002, which fits generally snugly within a coupling element 43. The handle 602, bearing element 1002 and coupling element 43, configured in this embodiment as an opening or indentation in the base of the holder 14, are lined up as shown and are connected by compressing them together for a secure attachment of the applicator to the holder 14.

In some embodiments, the holder 14 is weighted to be easy to hold with one hand, e.g., with two fingers of one hand. For example, the holder 14 may have a mass so as to weigh less than about 500 g (e.g., less than about 400 g, less than about 300 g, or less than about 200 g). In some embodiment the materials for manufacturing the holder 14 are chosen to be light weight and/or low density. For example, plastic, rubbers, foams, light wood (e.g., cork), light metals (e.g., aluminum), any combination thereof, or the like may be used. In some embodiments the holder 14 includes internal voids such as air bubbles, honeycomb structures, cavities, or the like).

In some embodiments the holder 14 is dimensioned to be easy to hold. For example, the holder 14 may have a length (length 170, as shown in FIG. 2C), and a width (width 169, as shown in FIG. 2A), each not more than about 5 cm. In addition, the total height is portioned to comfortably fit the base and ring portions in a hand. For example, the total height (height 166, as shown in FIG. 2A) is not more than about 8 cm and a height of base 15 (height 171, as shown in FIG. 2A) is not more than about 5 cm.

In some embodiments, one or more elements of the holder 14 may be textured to assist in preventing slippage. In some embodiments one of more elements of the holder 14 is made of a material with a high coefficient of friction against the skin of a gripping hand/finger. For example, the static coefficient of friction of the material can be greater than about 0.2 (e.g., greater than 0.3, greater that about 0.4, greater than about 0.5). In some embodiments the holder 14 comprises one or more of a plastic, rubber, metal, wood, or cork material. In some embodiments, the holder 14 can include "form fitting" or soft materials (e.g., foam), which deforms or indents upon contact with a user's fingers, thereby forming complementary indentations.

The holder 14 and applicators attached thereto such as, but not limited to, the applicator 48, can be used for many cosmetic or skincare applications. For example, the applicators and/or holders described herein may be used for applying creams, emulsions, lotions, liquids, serums, oils, powders, solutions, ointments, pastes, suspensions, balms, gels, sticks, sprays, ny combinations thereof, and the like. The applicators and/or holders can be used for the application of makeup, skincare, bath and body, and/or hair products including, but not limited to, the following: eye makeup such as brow pencils and fillers, mascara, eyeliner, eyeshadow, primer, hair (e.g., lash or brow) conditioners and treatments, false eyelashes, lash curlers; face makeup such as primers, foundations, concealers, powders, highlighters/brightening pigments, blush and contour, and setting sprays; lip cosmetics such as, lipstick, lip gloss, lip stains, lip balms, lip liners, exfoliates and conditioning treatments; and skincare such as cleansers, exfoliators, masks, moisturizers and anti-aging treatments.

As used herein, the term "comprising" or "comprises" is used in reference to compositions, methods, and respective component(s) thereof, that are essential to the claimed invention, yet open to the inclusion of unspecified elements, whether essential or not.

As used herein, the term "consisting essentially of" refers to those elements required for a given embodiment. The term permits the presence of elements that do not materially affect the basic and novel or functional characteristic(s) of that embodiment of the claimed invention.

The term "consisting of" refers to compositions, methods, and respective components thereof as described herein, which are exclusive of any element not recited in that description of the embodiment.

As used in this specification and the appended claims, the singular forms "a," "an," and "the" include plural references unless the context clearly dictates otherwise. Thus, for example, references to "the method" includes one or more methods and/or steps of the type described herein and/or that will become apparent to those persons skilled in the art upon reading this disclosure and so forth. Similarly, the word "or" is intended to include "and" unless the context clearly indicates otherwise.

Other than in the operating examples, or where otherwise indicated, all numbers expressing quantities of ingredients or reaction conditions used herein should be understood as modified in all instances by the term "about." The term "about," when used in connection with percentages, may mean±5% (e.g., ±4%, ±3%, ±2%, ±1%) of the value being referred to.

Where a range of values is provided, each numerical value between the upper and lower limits of the range is contemplated and disclosed herein.

Unless otherwise defined herein, scientific and technical terms used in connection with the present application shall have the meanings that are commonly understood by those of ordinary skill in the art. Further, unless otherwise required by context, singular terms shall include pluralities, and plural terms shall include the singular.

It should be understood that the embodiments disclosed herein are not limited to the particular methodology, protocols, and reagents, etc., described herein and as such may vary. The terminology used herein is for the purpose of describing particular embodiments only and is not intended to limit the scope of the present invention, which is defined solely by the claims.

Embodiments of the various aspects described herein can be illustrated by the following numbered paragraphs.

1. A cosmetic applicator holder comprising:

a base having a finger contact area configured for contact with a user's volar or dorsal surface of two fingers, a shaft extending from the base along a shaft primary axis and configured to be placed between and contacting the sides of the two fingers, an enlarged portion extending from the shaft and positioned distal to the base, the enlarged portion having a surface configured for contact with the volar or dorsal surface of the two fingers, and, an applicator coupling element for coupling of an applicator to the base.

2. The holder as in paragraph 1, wherein the applicator coupling element is configured to couple to an applicator handle so that a primary axis of the applicator handle is oriented substantially perpendicular to the shaft primary axis.

3. The holder as in paragraph for 2, wherein the applicator coupling element is configured for removably coupling the applicator to the base.

4. The holder as in any one of paragraphs 1-3, wherein the base further comprises a thumb grip area disposed on a surface generally opposite to the finger contact area.

5. The holder as in paragraphs 4, wherein the thumb grip area is a substantially flat portion on the holder surface shaped and positioned such that the user's thumb can be comfortably fit thereon when the user grips the holder such that the volar surface of at least one finger is in contact with the finger contact area of the base.

6. The holder as in paragraph 4, wherein the thumb grip area comprises a textured surface for assisting in preventing the user's thumb from slipping when it is being used.

7. The holder as in any one of paragraphs 1-6, wherein the coupling element and applicator handle comprise a male and female coupling combination or pair.

8. The holder as in paragraph 7, further comprising a bearing or fitting element for secure fastening of the applicator handle to the coupling element.

9. An assembly comprising, a holder including an applicator coupling element, an applicator having a handle coupled to the holder via the applicator coupling element, and a vessel configured for connection to the holder and over the applicator during storage, wherein the holder comprises, a base having (e.g., curved outer surfaces) and a finger contact area configured for contact with a user's volar or dorsal surface of two fingers, a shaft extending from the base along a shaft primary axis and configured to be placed between and contacting the sides of the two fingers, an enlarged portion extending from the shaft and positioned distal to the base, the enlarged portion having a surface configured for contact with the volar or dorsal surface of the two fingers, and, an applicator coupling element for coupling of the applicator to the holder.

10. The assembly as in paragraph 9, wherein the applicator comprises an eyelash, eyelid, cheek lip, or eyebrow applicator.

11. The assembly as in paragraph 9 or 10, wherein the applicator comprises a tip curved away from a principle axis of the handle and comprises a peek or see-through hole.

12. The assembly as in paragraph 11, wherein the applicator tip comprises at least two working surfaces for applying a cosmetic formulation.

13. A method for applying makeup comprising;

holding an applicator holder fitted with an applicator and contacting the applicator to the application area, wherein the applicator holder comprises, a base having and a finger contact area configured for contact with a user's volar or dorsal surface of two fingers, a shaft extending from the base along a shaft primary axis and configured to be placed between and contacting the sides of the two fingers, an enlarged portion extending from the shaft and positioned distal to the base, the enlarged portion having a surface configured for contact with the volar or dorsal surface of the two fingers, and, an applicator coupling element for coupling of an applicator to the base and, wherein the holding comprises placing the shaft of the holder between two fingers of one hand.

14. The method of paragraph 13, wherein the holding comprises orienting the hand so that a primary axis of a handle of the applicator is oriented in a direction substantially parallel with a plane defined by two phalanges of the two fingers and perpendicular to the shaft primary axis.

15. The method of paragraph 13 or 14, wherein the holding comprises contacting the volar surface of the two fingers with the finger contact area of the base and contacting the dorsal surface of the two fingers with the enlarged portion of the holder.

16. The method of paragraph 13 or 14, wherein the holding comprises contacting the dorsal surface of the two fingers with the finger contact area of the base and contacting the volar surface of the other finger with the enlarged portion of the holder.

17. The method of any one of paragraphs 13-16, further comprising contacting a thumb, a finger or palm of the hand to the face to provide stabilization of the hand during applying makeup.

18. The method of any one of paragraphs 13-17, wherein the holder includes a thumb grip and holding comprises contacting the thumb of the hand to the thumb grip.

19. The method of any one of paragraphs 13-18, wherein the applying makeup comprises applying or removing a formulation to the eyelashes, eyebrows, cheeks, face, skin, hair or lips.

What is claimed is:

1. An cosmetic applicator comprising:

a holder including a base coupled to a handle of an applicator via an applicator coupling element; and a vessel configured to (i) connect to the base of the holder and (ii) be placed over the applicator during storage, wherein the holder further comprises:

a finger contact area on the base and configured to contact with volar or dorsal surfaces of two fingers of a user;

a shaft fixedly attached to and extending from the base along a shaft primary axis, the shaft configured to be placed between sides of the two fingers, the shaft being configured to contact the sides of the two fingers; and an enlarged portion extending from the shaft and positioned distal to the base, the enlarged portion having an inner surface configured to contact a portion of remaining surfaces of the two fingers, the shaft primary axis having one end attached to the base and an opposite end attached to the enlarged portion;

and wherein the applicator comprises a spoolie or a brush.

2. The assembly as in claim 1, wherein the applicator comprises a tip curved away from a principle axis of the handle.

3. The assembly as in claim 2, wherein the applicator tip comprises at least two working surfaces for applying a cosmetic formulation.

4. The assembly as in claim 1, wherein the holder is dimensioned such that the base distal from the handle of the applicator is configured to be held inside a palm of the hand of the user, thereby providing stabilization during makeup application.

5. A method for applying makeup, the method comprising:

holding an applicator holder coupled to an applicator; and contacting the applicator to an application area, wherein the applicator holder comprises:

a base having a finger contact area configured to contact volar or dorsal surfaces of two fingers of a hand of a user;

a shaft fixedly attached to and extending from the base along a shaft primary axis, the shaft configured to be placed between sides of the two fingers, the shaft being configured to contact the sides of the two fingers;

an enlarged portion extending from the shaft and positioned distal to the base, the enlarged portion having an inner surface configured to contact a portion of remaining surfaces of the two fingers, the shaft primary axis having one end attached to the base and an opposite end attached to the enlarged portion; and an applicator coupling element for coupling of an applicator handle of the applicator to the base, and wherein the holding comprises:

placing the shaft of the applicator holder between the two fingers of the user one hand; and curling the hand underneath an end of the base distal to the applicator coupling element for stabilization of the applicator holder.

6. The method of claim 5, wherein the holding comprises orienting the hand so that a primary axis of a handle of the applicator is oriented in a direction substantially parallel with a plane defined by two phalanges of the two fingers and perpendicular to the shaft primary axis.

7. The method of claim 5, wherein the holding comprises contacting the volar surfaces of the two fingers with the finger contact area of the base while contacting the dorsal surfaces of the two fingers with the enlarged portion of the holder.

8. The method of claim 5, wherein the holding comprises contacting the dorsal surfaces of the two fingers with the finger contact area of the base while contacting the volar surfaces of the other finger with the enlarged portion of the holder.

9. The method of claim 5, further comprising contacting a thumb, a finger or palm of the hand to the face to provide stabilization of the hand during applying makeup.

10. The method of claim 5, wherein the holder includes a thumb grip and holding comprises contacting the thumb of the hand to the thumb grip.

11. The method of claim 5, wherein the applying makeup comprises applying or removing a formulation to the eyelashes, eyebrows, cheeks, face, skin, hair or lips.

* * * * *